US006558177B2

(12) United States Patent
Havener et al.

(10) Patent No.: US 6,558,177 B2
(45) Date of Patent: May 6, 2003

(54) FLOATING COAXIAL CONNECTOR

(75) Inventors: Jacob G. Havener, Harrisburg, PA (US); Kevin E. Weidner, Hummelstown, PA (US); Robert Stewart Correll, Jr., Harrisburg, PA (US); Raymond L. Landon, III, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/011,066

(22) Filed: Nov. 8, 2001

(65) Prior Publication Data

US 2002/0061670 A1 May 23, 2002

Related U.S. Application Data

(60) Provisional application No. 60/252,535, filed on Nov. 22, 2000.

(51) Int. Cl.[7] ..... H01R 13/64

(52) U.S. Cl. ..... 439/246; 439/248

(58) Field of Search ..... 439/246, 247, 439/248, 71, 83, 180, 188, 578, 579, 580

(56) References Cited

U.S. PATENT DOCUMENTS 5,516,303 A * 5/1996 Yohn et al. ..... 439/248
5,769,652 A 6/1998 Wider ..... 439/248
5,775,927 A 7/1998 Wider ..... 439/188
6,203,331 B1 * 3/2001 McHugh et al. ..... 439/71
6,224,407 B1 * 5/2001 Duquerroy et al. ..... 439/188
6,280,254 B1 * 8/2001 Wu et al. ..... 439/630

* cited by examiner

*Primary Examiner*—Renee Luebke
*Assistant Examiner*—Alexander Gilman

(57) ABSTRACT

A coaxial connector having shell assemblies including shells and contacts is provided for accepting misalignment of connectors during blind mating. The coaxial connector includes a first shell having a cavity and a second shell that resides in the cavity of the first shell. The second shell is movable relative to the first shell. The first shell assembly has a first contact that resides in the first shell, and the second shell assembly has a second contact that resides in the second shell. The second contact is in direct contact with the first contact, and the first and second contacts are movable relative to each other while maintaining direct contact. The shell assemblies are arranged along longitudinal axes that are concentric with one another and overlap in an unbiased position. When the shell assemblies are moved relative to one another, the axes no longer overlap.

23 Claims, 5 Drawing Sheets

FLOATING COAXIAL CONNECTOR

RELATED APPLICATIONS

This application claims priority from U.S. Provisional Application No. 60/252,535, filed Nov. 22, 2000, which is expressly incorporated by reference herein in its entirety.

BACKGROUND OF THE INVENTION

Certain embodiments of the present invention generally relate to a floating coaxial connector, and an electrical system having a floating coaxial connector for electrically connecting circuit boards and other structures.

In some applications, connectors for electrical components such as circuit boards are blindly mated with each other, as the operator cannot see the connection to be made. Misalignment between two connectors or connector halves when attempting to be blindly mated may prevent a connection entirely, particularly where the connectors cannot accommodate the misalignment. If one of the connectors is mounted to a cable, the terminated cable end can move freely to accommodate misalignment between the connectors. The use of cable mounting, however, is costly, space-consuming, and inconvenient.

To address the problems of cable-mounted connectors, mating connectors soldered to circuit boards have been employed. The mounted connectors must provide some form of floating system to accommodate misalignment. U.S. Pat. No. 5,769,652 discloses one such system utilizing a spring between a front and a rear contact. The spring permits the front and rear contact to float relative to each other and provides a path for signal transmission between the front and rear contact.

Use of the spring, however, has several drawbacks. The spring increases the resistance in the path between the contacts and adversely affects the signal transmission performance. The spring also takes up space which is at a premium in many applications. Use of a spring between the contacts further necessarily requires added time and expense for mounting the spring to the contacts. Moreover, devices using springs between the contacts may not provide adequate range of movement to accept misalignment in some applications.

It is an object of at least certain embodiments of the present invention to overcome the above-noted and other disadvantages of floating connectors.

BRIEF SUMMARY OF THE INVENTION

At least one embodiment of the present invention is provided including a coaxial connector including a first shell or body having a cavity, a second shell or body that resides in the cavity and is movable relative to the first shell, a first contact that resides within the first shell, and a second contact which resides within the second shell. The first and second contacts are movable relative to each other while still maintaining direct contact. Optionally, the first and second contacts include substantially planar first and second contact surfaces, respectively, that slide parallel to each other while maintaining direct contact. Alternatively, the first and second shells may define parallel first and second axes, respectively, that do not remain parallel while the first and second contact surfaces move relative to one another. Optionally, the second contact may include an upper contact arm and a lower contact arm joined by an intermediate portion. The intermediate portion biases the upper contact arm into direct engagement with the first contact. Additionally, the connector may include a flared end configured to receive a mating coaxial connector.

The coaxial connector may additionally comprise a spring that resides between the first and second shells. The spring urges the first and second shells into contact with one another. Optionally, the spring may be a tapered spring having first and second diameters, contacting the first shell at the first diameter and the second shell at the second diameter.

The second contact is movable with respect to the first shell to align with a mating contact of a mating coaxial connector. The second contact remains physically abutted against the first contact throughout the movement to align with the mating contact.

The second contact may be configured to accept a center coaxial contact of a mating connector. One of the first and second shells may be configured to engage an outer coaxial contact of a mating connector.

At least one embodiment of the present invention provides an electrical system including a first circuit board, a second circuit board, a first connector, and a second connector. The first connector mounts to the first circuit board and includes an outer body, an inner body, a first contact, and a second contact. The outer body includes a mounting area for mounting to the first circuit board. The outer body includes a cavity, within which the inner body resides. The inner body is in contact with and movable relative to the outer body. The first contact resides in the outer body and has a contacting surface for electrically communicating with the first circuit board. The second contact resides in the inner body and is in direct contact with the first contact. Further, the first and second contacts are movable relative to each other while maintaining direct contact with one another. The second connector mounts to the second circuit board and is matable to the first connector. The second connector includes a body and a contact that resides in the body. The contact has a contacting surface for electrically communicating with the second circuit board. Also, the contact engages the second contact of the inner body when the first and second connectors are mated to provide communication between the first and second circuit boards.

The second contact of the inner body is movable with respect to the outer body to align with the contact of the second connector. The second contact of the inner body remains physically abutted to the first contact of the outer body throughout movement to align with the mating contact.

The second contact of the inner body and the contact of the second connector are configured to engage each other and provide a first path of electrical communication between the first and second circuit boards. Additionally, the inner body of the first connector and the body of the second connector are configured to engage each other and provide a second path of electrical communication between the first and second circuit boards.

Certain embodiments of the present invention thus accommodate misalignment for blindly mating electrical connectors. Little space is required, and cost of production is low. Further, there is low resistance through the contacts, and a large range of motion to accommodate misalignment is also provided.

Figure 1:
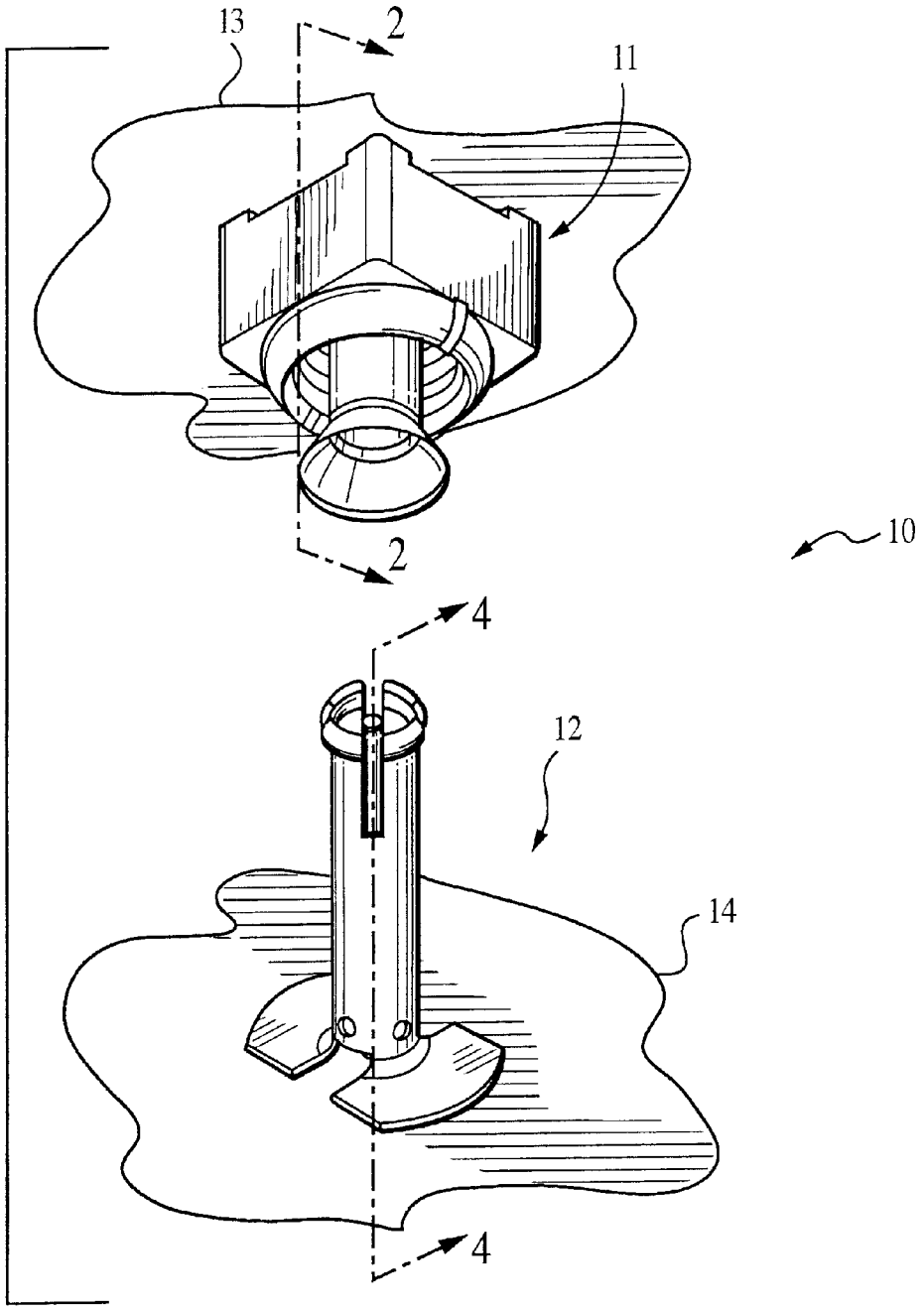
FIG. 1 illustrates a perspective view of a floating coaxial connector assembly formed in accordance with an embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates a floating coaxial connector assembly 10. The connector assembly 10 comprises a jack assembly 11, a plug assembly 12, a first circuit board 13, and a second circuit board 14. The jack assembly 11 is mounted to the first circuit board 13, and the plug assembly 12 is mounted to the second circuit board 14. When the jack assembly 11 and the plug assembly 12 are mated, they provide electrical communication between the first circuit board 13 and the second circuit board 14.

Figure 2:
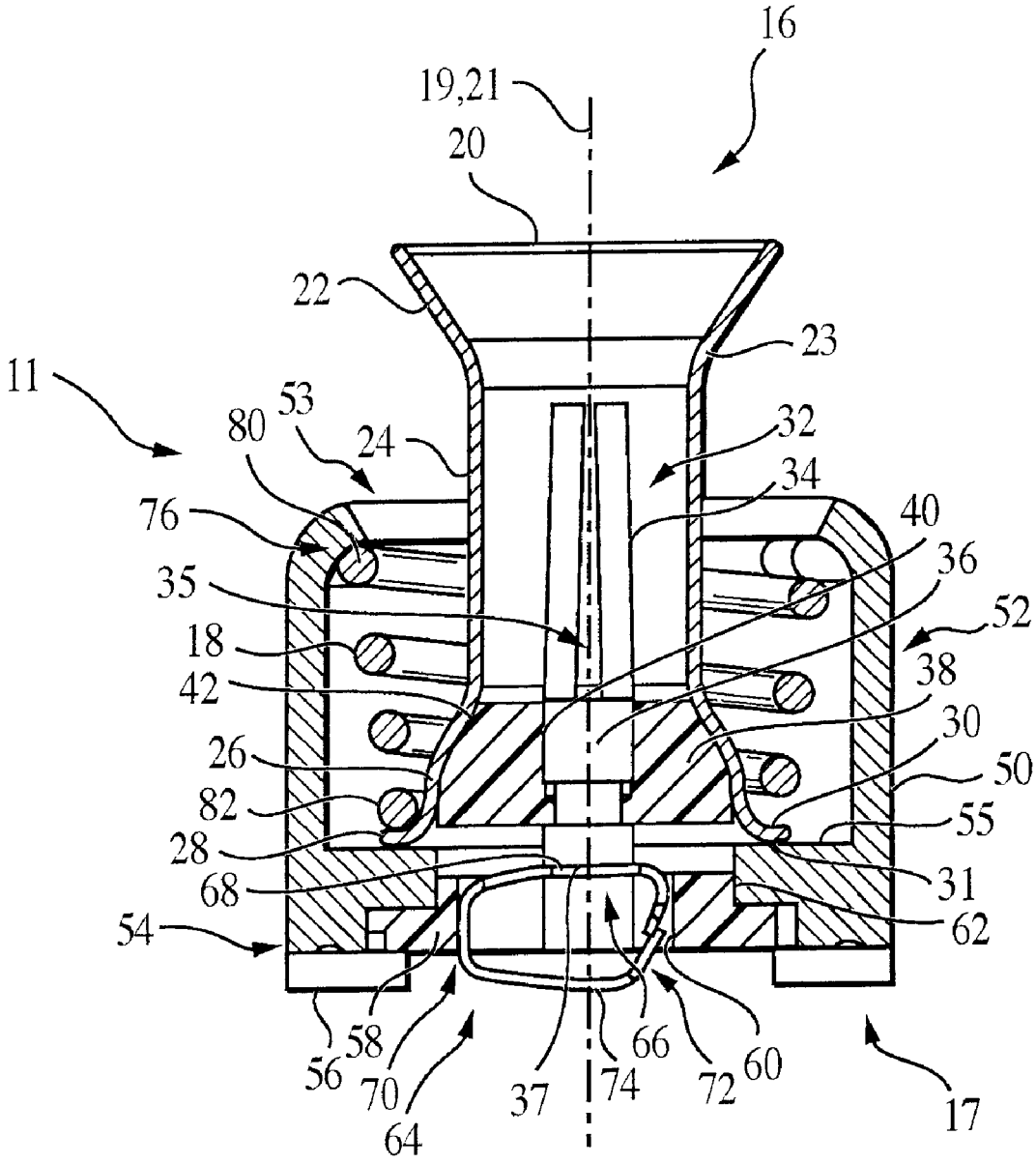
FIG. 2 illustrates a sectional elevation view of a jack connector in the floating coaxial connector assembly of the embodiment illustrated in FIG. 1 in an unbiased position taken along line 2—2 in FIG. 1.

FIG. 2 illustrates a sectional elevation view of a jack assembly 11 in an unbiased position. The jack assembly 11 comprises an inner jack assembly 16, an outer jack assembly 17, and a spring 18. In the illustrated embodiment, the outer jack assembly 17 mounts to the first circuit board 13, and the inner jack assembly 16 mates with the plug assembly 12. The inner jack assembly 16 may be biased in both radial and angular directions from the position illustrated in FIG. 2 relative to the outer jack assembly 17 during mating with the plug assembly 12. The spring 18 resides between the inner jack assembly 16 and the outer jack assembly 17 and urges them into electrical contact and to the position shown in FIG. 2. The inner and outer jack assemblies 16 and 17 are arranged along longitudinal axes 19 and 21, respectively. In FIG. 2, the axes 19 and 21 are arranged concentric with one another such that the longitudinal axes 19 and 21 overlap one another. Stated another way, the inner jack assembly 16 is radially centered within, and oriented to extend parallel to, the outer jack assembly 17.

The inner jack assembly 16 comprises an inner jack shell 20 surrounding an upper center contact 32, and being spaced apart by an inner jack dielectric 38. The upper center contact 32 may be pressed into the inner jack dielectric 38. In turn, the inner jack dielectric 38 may be pressed into the inner jack shell 20. In this way, the upper center contact 32 may be fixed inside the inner jack shell 20.

The inner jack shell 20 comprises a top portion 22, a middle portion 24, and a bottom portion 26 defining cylindrical and/or generally conic shapes substantially concentric with respect to each other and having walls of generally similar thickness. The top portion 22 defines a generally conic shape and comprises a bend 23 from which it flares outward to provide a leading edge with which to accept the plug assembly 12 when the jack assembly 11 and plug assembly 12 are mated. The middle portion 24 is tubular and extends substantially cylindrically between the top portion 22 and the bottom portion 26. The bottom portion 26 has a staged increasing diameter as it extends from the middle portion 24 and comprises a lip 28 rolled outward. The upper surface of the lip 28 includes a shelf 30 while the lower surface includes a contact surface 31. The inner jack shell 20 is made of a conductive material, as the inner jack shell 20 provides a conductive path between the plug assembly 12 and the outer jack assembly 17. Bronze and brass may be used for the inner jack shell 20.

The upper center contact 32 includes beams 34 extending from a lower portion 36. A slot 35 extends through the top of the upper center contact 32 separating the beams 34, and accepts the contact of a plug assembly 12 during mating. The slot 35 is sized to securely accept a plug contact and is preferably wider at the slot base than at the top of the upper center contact 32. The bottom of the lower portion 36 includes a contacting surface 37. The upper center contact 32, which provides a conductive path between the plug assembly 12 and the outer jack assembly 17, is made of a conductive material, such as phosphor bronze. The shells and contacts may have gold plating.

The inner jack dielectric 38 resides between the inner jack shell 20 and the upper center contact 32 and comprises an inner surface 40 and an outer surface 42. The inner surface 40 comprises a generally cylindrical opening configured to accept the lower portion 36 of the upper center contact 32, while the outer surface 42 defines a surface configured to be accepted by the interior surface of the bottom portion 26 of the inner jack shell 20. The upper center contact 32 is pressed into the inner jack dielectric 38 and held in place by the resilience of the material, surface features (such as barbs or other projections, for example) on the lower portion 36 and/or the inner surface 40, stakes, rivets, and/or other mounting techniques, either alone or in combination. The inner jack dielectric 38 is pressed into the inner jack shell 20 and secured in similar fashion. The inner jack dielectric 38 provides physical support to the upper center contact 32 and helps insulate the upper center contact 32 from the inner jack shell 20, thereby allowing two different paths of electrical conduction through the inner jack assembly 16. Further, the inner jack dielectric material is selected to have a dielectric constant to provide a desired characteristic impedance for improved performance. PTFE may be used for the inner jack dielectric 38.

The outer jack assembly 17 comprises a outer jack shell 50, a lower center contact 64, and an outer jack dielectric 58. The lower center contact 64 may be pressed into the outer jack dielectric 58. In turn, the outer jack dielectric 58 may be pressed into the outer jack shell 50. In this way, the lower center contact 64 may be fixed inside the outer jack shell 50.

The outer jack shell 50 comprises an upper portion 52, a lower portion 54, and feet 56. The interior of the upper portion 52 defines a cavity 53, the top of which comprises a shoulder 76 and the bottom of which comprises a contact surface 55. The interior of the lower portion 54 defines one or more diameters configured to accept the outer jack dielectric 58. The lower portion 54 comprises feet 56 for mounting to the first circuit board 13. The outer jack shell 50 is made of a conductive material, as the outer jack shell 50 provides a conductive path between the inner jack shell 20 and the first circuit board 13. Brass and zinc may be used for the outer jack shell 50.

The profile of the lower center contact 64 as shown in FIG. 2 generally defines a closed "C" shape. The top leg of the "C" may be biased with respect to the bottom leg of the "C" while remaining in contact thereto, thus providing a direct electrical path from the top leg to the bottom leg. In this regard, the lower center contact 64 comprises an upper arm 66, an intermediate portion 70, and a lower arm 72. The intermediate portion 70 is joined to one end each of the upper arm 66 and the lower arm 72. The free ends (those not joined to the intermediate portion) of the upper arm 66 and the lower arm 72 are in contact with each other, but free to move. In this way, the upper arm 66 may be biased from the lower arm 72 while still maintaining a direct electrical path from the upper arm 66 to the lower arm 72. The upper arm 66 comprises an upper contacting surface 68 that contacts the contacting surface 37 of the upper center contact 32 when the jack assembly 11 is assembled. The resiliency of the lower center contact 64 provides a spring force that biases the upper arm 66 upward and the upper contacting surface 68 against the upper center contact 32. The lower arm 72 comprises a lower contacting surface 74 that provides an electrical connection to the first circuit board 13. The lower center contact 64, which provides a conductive path between the upper center contact 32 and the first circuit board 13, is made of a conductive material, such as phosphor bronze.

The outer jack dielectric 58 resides between the outer jack shell 50 and the lower center contact 64 and comprises an inner surface 60 and an outer surface 62. The inner surface 60 comprises a generally cylindrical opening configured to accept the lower contact 64, while the outer surface 62 defines a surface configured to be accepted by the interior part of the lower portion 54 of the outer jack shell 50. The lower center contact 64 is pressed into the outer jack dielectric 58 and held in place by the resilience of the material, surface features on the intermediate portion 70 and/or the inner surface 60, stakes, rivets, and/or other mounting techniques, either alone or in combination.

The outer jack dielectric 58 is pressed into the outer jack shell 50 and held in place by the resilience of the material, surface features on the outer surface 62 and/or the interior surface of the lower portion 54, stakes, rivets, and/or other mounting techniques, either alone or in combination. The lower contacting surface 74 is substantially flush with the mounting surface of the feet 56 when the outer jack assembly 17 is assembled to facilitate soldering the lower contacting surface 74 and the feet 56 to the first circuit board 13. The outer jack dielectric 58 provides physical support to the lower center contact 64 and helps insulate the lower center contact 64 from the outer jack shell 50, thereby allowing two different paths of electrical conduction through the outer jack assembly 17. Further, the outer jack dielectric material is selected to have a dielectric constant to provide a desired characteristic impedance for improved performance, and also to not melt during the process of soldering portions of the outer jack assembly 17 to the first circuit board 13. Injection molded plastic may be used for the outer jack dielectric 58.

The spring 18 resides between the inner jack assembly 16 and the outer jack assembly 17. The spring 18 comprises an upper spring portion 80 and a lower spring portion 82. The spring 18 abuts against the shelf 30 of the inner jack shell 20 and the shoulder 76 of the outer jack shell 50. The upper spring portion 80 abuts against the shoulder 76, and the lower spring portion 82 abuts against the shelf 30. The spring 18 is a tapered coil spring, tapering from a larger first diameter at the upper spring portion 80 to a smaller second diameter at the lower spring portion 82.

To assemble the jack assembly 11, the inner jack assembly 16 may first be assembled as described above. Next, the outer jack assembly 17 may be formed essentially as described above; however, the shoulder 76 of the upper portion 52 of the outer jack shell 50 is not yet formed. Rather, the top of the cavity 53 includes an opening larger than the first diameter at the upper spring portion 80. When the spring 18 positioned on the outer jack assembly 17 such that the lower spring portion 82 abuts against the shelf 30, the outer jack assembly 17 and spring 18 may then be lowered into the cavity 53 until the contact surface 31 of the inner jack shell 20 abuts against the contact surface 55 of the outer jack shell 50. In this position, the contacting surface 37 of the upper center contact 32 will abut against the upper contacting surface 68 of the lower center contact 64. As the inner jack assembly 16 is lowered in place, the upper center contact 32 contacts the lower center contact 64 before the inner jack shell 20 abuts against the outer jack shell 50, thereby biasing the upper arm 66 downward and, via the resiliency of the lower center contact 64, providing a secure connection between the center contacts and maintaining pressure for electrical continuity of a signal path through the contacts. The shoulder 76 may be formed such that the opening at the top of the cavity 53 is smaller than the first diameter at the upper spring portion 80, retaining the spring 80 in the cavity 53 and biasing the spring 80 to urge the inner jack shell 20 and the outer jack shell 50 into contact at the abutment at the contact surface 31 of the inner jack shell 20 and the contact surface 55 of the outer jack shell 50, helping maintain pressure for electrical continuity of a signal path through the shells.

Figure 3:
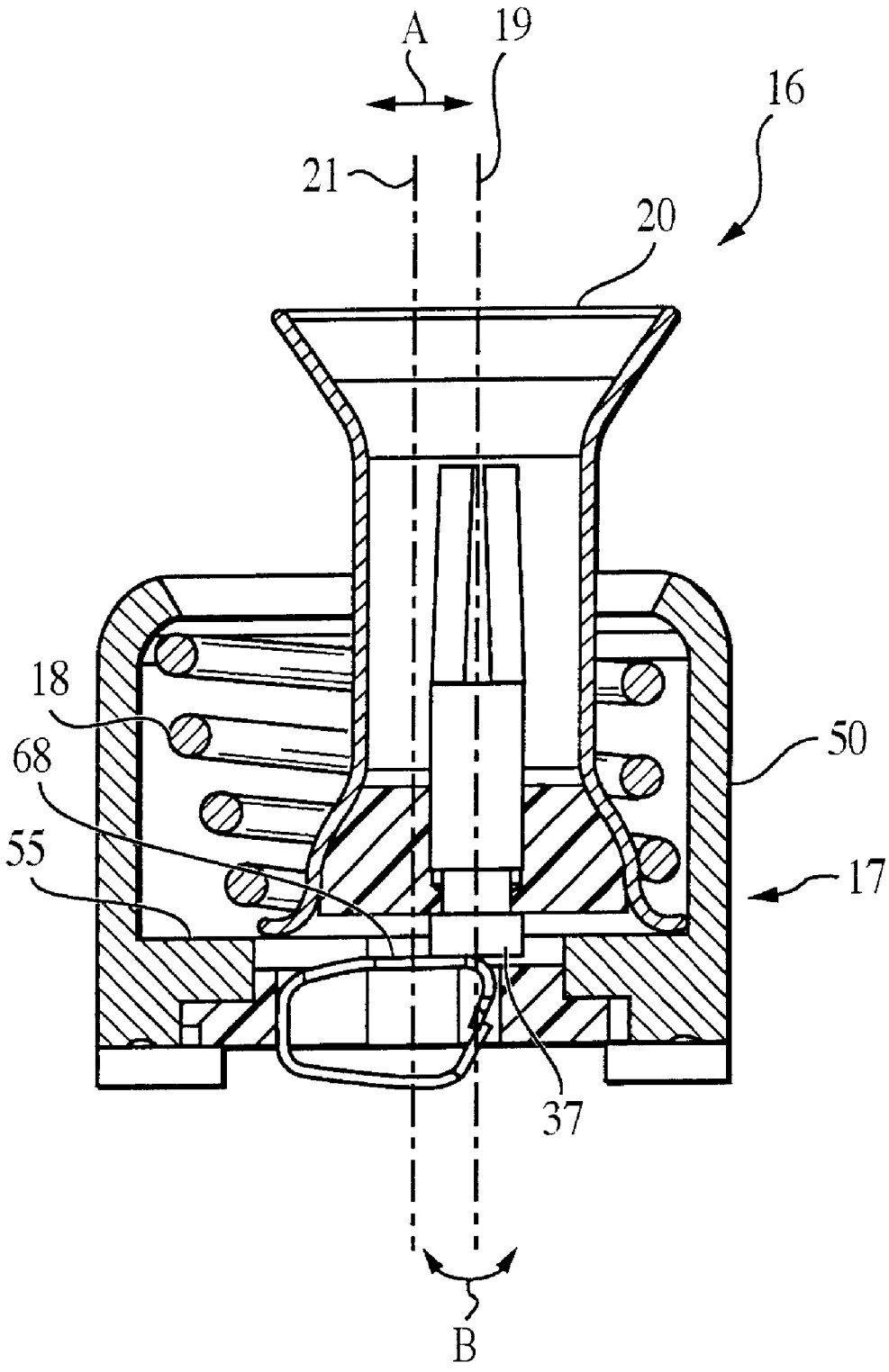
FIG. 3 illustrates a sectional elevation view of a jack connector in the floating coaxial connector assembly of the embodiment illustrated in FIG. 1 in a biased position from the position shown in FIG. 2.

When the jack shells 20 and 50 are positioned such that their longitudinal axes 19 and 20 are aligned, the first diameter at the upper spring portion 80 is large enough to provide a clearance with the exterior of the inner jack shell 20, and the second diameter at the lower spring portion 82 embraces the bottom portion 26 of the inner jack shell 20. Further, there is clearance between the inner jack shell 20 and the interior surfaces of the cavity 53. Thus, while the spring 80 urges the jack shells together, it allows the inner jack shell 20 to float radially in the direction of arrow A with respect to the outer jack shell 50, as shown in FIG. 3. The inner jack assembly 16 may also be tilted in the direction of arrow B to form an acute angle between the longitudinal axes 19 and 21, because the rolled lip 28 of the inner jack shell 20 provides a non-planar contact surface 31 which may pivot as well as slide with respect to the contact surface 55 of the outer jack shell 50. This provides internal radial float in the jack assembly 11, allowing the jack shells to be biased from a position where their longitudinal axes are aligned. The spring 80 maintains the contact between the inner jack shell 20 and the outer jack shell 50, as well as the contact between the upper center contact 32 and the lower center contact 64, throughout the movement of the inner jack shell 20 relative to the outer jack shell 50. The direct contact between the upper center contact 32 and the lower center contact 64 provides lower resistance and takes up little space, while also reducing assembly time and costs. The configuration of FIGS. 2–3 also provides a large range of radial and angular motion to compensate for misalignment.

To mount the jack assembly 11 to the first circuit board 13, standard soldering techniques may be used. The feet 56 are soldered to a group of foot pads (not shown) on the first circuit board 13, and the lower contacting surface 74 is soldered to a contact pad (not shown) on the first circuit board 13. Thus, the mounted jack assembly 11 provides two paths of electrical conductivity. An outer path is formed from the inner jack shell 20 to the outer jack shell 50 to the foot pads of the first circuit board 13. An inner path is formed from the upper center contact 32 to the lower center contact 64 to the contact pad of the first circuit board 13. To provide electrical communication, the jack assembly 11 is mated with a plug assembly 12.

Figure 4:
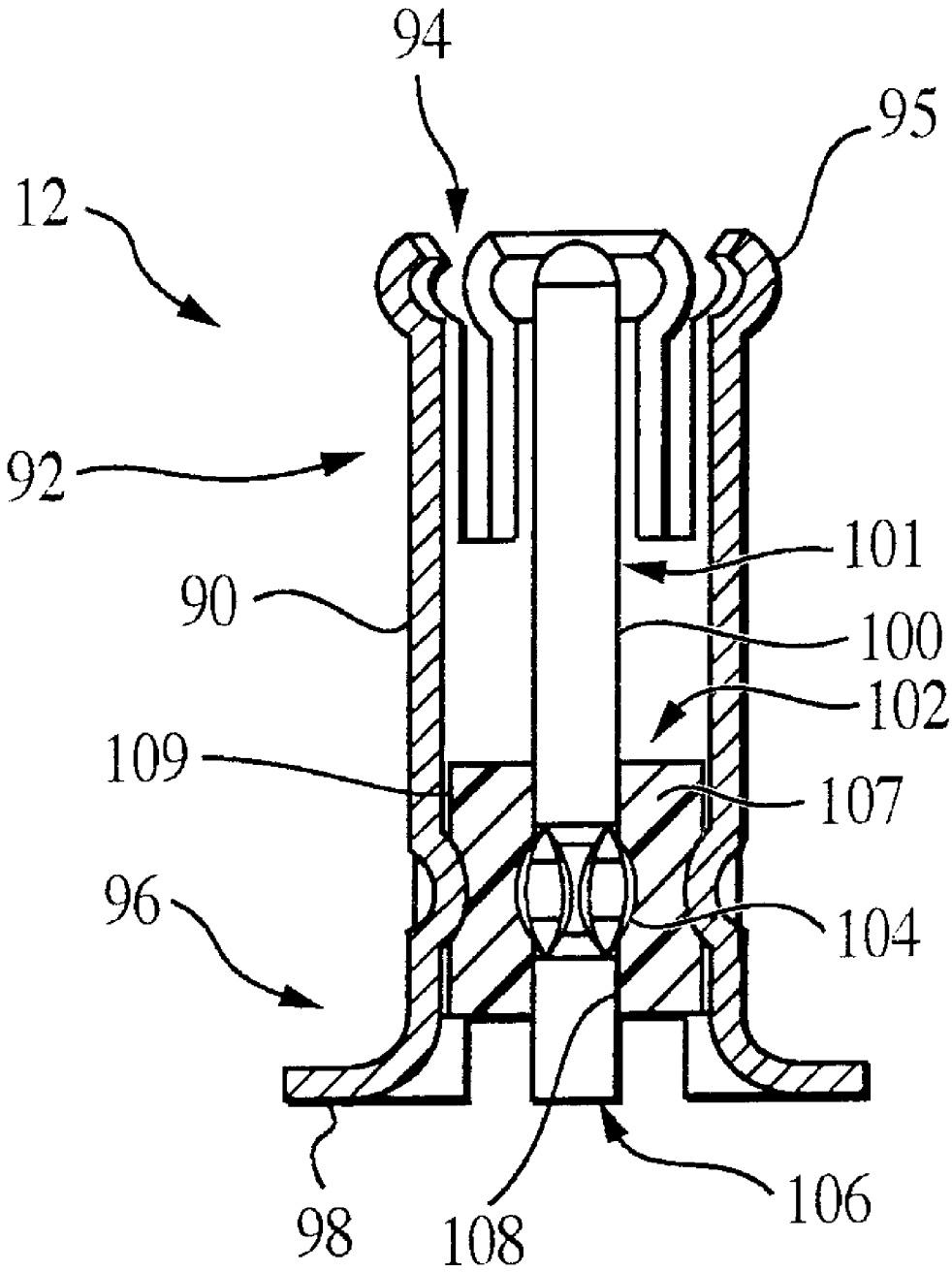
FIG. 4 illustrates a sectional elevation view of a plug connector in the floating coaxial connector assembly of the embodiment illustrated in FIG. 1 taken along line 4—4 in FIG. 1.

FIG. 4 illustrates a sectional elevation view of a plug assembly 12. The plug assembly 12 comprises a plug shell 90, a plug contact 100, and a plug dielectric 107. The plug contact 100 may be pressed into the plug dielectric 107. In turn, the plug dielectric 107 may be pressed into the plug shell 90. In this way, the plug contact 100 may be fixed inside the plug shell 90.

The plug shell 90 comprises an upper portion 92 and a lower portion 96. The upper portion 92 comprises slots 94 and bulges 95. The bulges 95 are sized such that they will contact the interior of the inner jack shell 20 (with the slots 94 helping the upper portion 92 to bias resiliently inward) when the plug assembly 12 and the jack assembly 11 are mated. The lower portion 96 comprises feet 98 for mounting to the second circuit board 14. A generally circular cross-section configured to accept the plug dielectric 107 is defined by the interior of the lower portion 96. A conductive material is used for the plug shell 90, as the plug shell 90 provides a conductive path between the inner jack shell 20 and the second circuit board 14. Phosphor bronze may be used for the plug shell 90.

The plug contact 100, which is generally pin shaped, comprises an upper portion 101 and a lower portion 102. The upper portion 101 is sized to be accepted by the slot 35 of the upper center contact 32 and features a tapered leading edge. The lower portion 102 comprises projections 104 that help secure the plug contact 100 in the plug dielectric 107. The bottom of the lower portion 102 includes a contacting surface 106. The plug contact 100 provides a conductive path between the second circuit board 14 and the upper center contact 32, and is made of a conductive material, such as brass.

The plug dielectric 107 resides between the plug shell 90 and the plug contact 100 and comprises an inner surface 108 and an outer surface 109. The inner surface 108 comprises a generally cylindrical opening configured to accept the plug contact 100, while the outer surface 109 defines a surface configured to be accepted by the interior part of the lower portion 96 of the plug shell 90. The plug contact 100 is pressed into the plug dielectric 107 and held in place by the resilience of the material, surface features on the lower portion 102 (such as the projections 104) and/or the inner surface 108, stakes, rivets, and/or other mounting techniques, either alone or in combination.

The plug dielectric 107 is pressed into the plug shell 90 and held in place by the resilience of the material, surface features on the outer surface 109 and/or the interior surface of the lower portion 96 of the plug shell 90, stakes, rivets, and/or other mounting techniques known in the art, either alone or in combination. The contacting surface 106 is substantially flush with the mounting surface of the feet 98 when the plug assembly 12 is assembled to facilitate soldering the contacting surface 106 and the feet 98 to the second circuit board 14. The plug dielectric 107 provides physical support to the plug contact 100 and helps insulate the plug contact 100 from the plug shell 90. Thus, the plug dielectric 107 allows two different paths of electrical conduction through the plug assembly 12. The material used for the plug dielectric 107 is selected to have a dielectric constant to provide a desired characteristic impedance for improved performance. PTFE may be used for the plug dielectric 107.

To mount the plug assembly 12 to the second circuit board 14, standard soldering techniques may be used. The feet 98 are soldered to a group of foot pads (not shown) on the second circuit board 14, and the contacting surface 106 is soldered to a contact pad (not shown) on the second circuit board 14. Thus, the mounted plug assembly 12 provides two paths of electrical conductivity. An outer path is formed from the plug shell 90 to the foot pads of the second circuit board 14. An inner path is formed from the plug contact 90 to the contact pad of the second circuit board 14.

Figure 5:
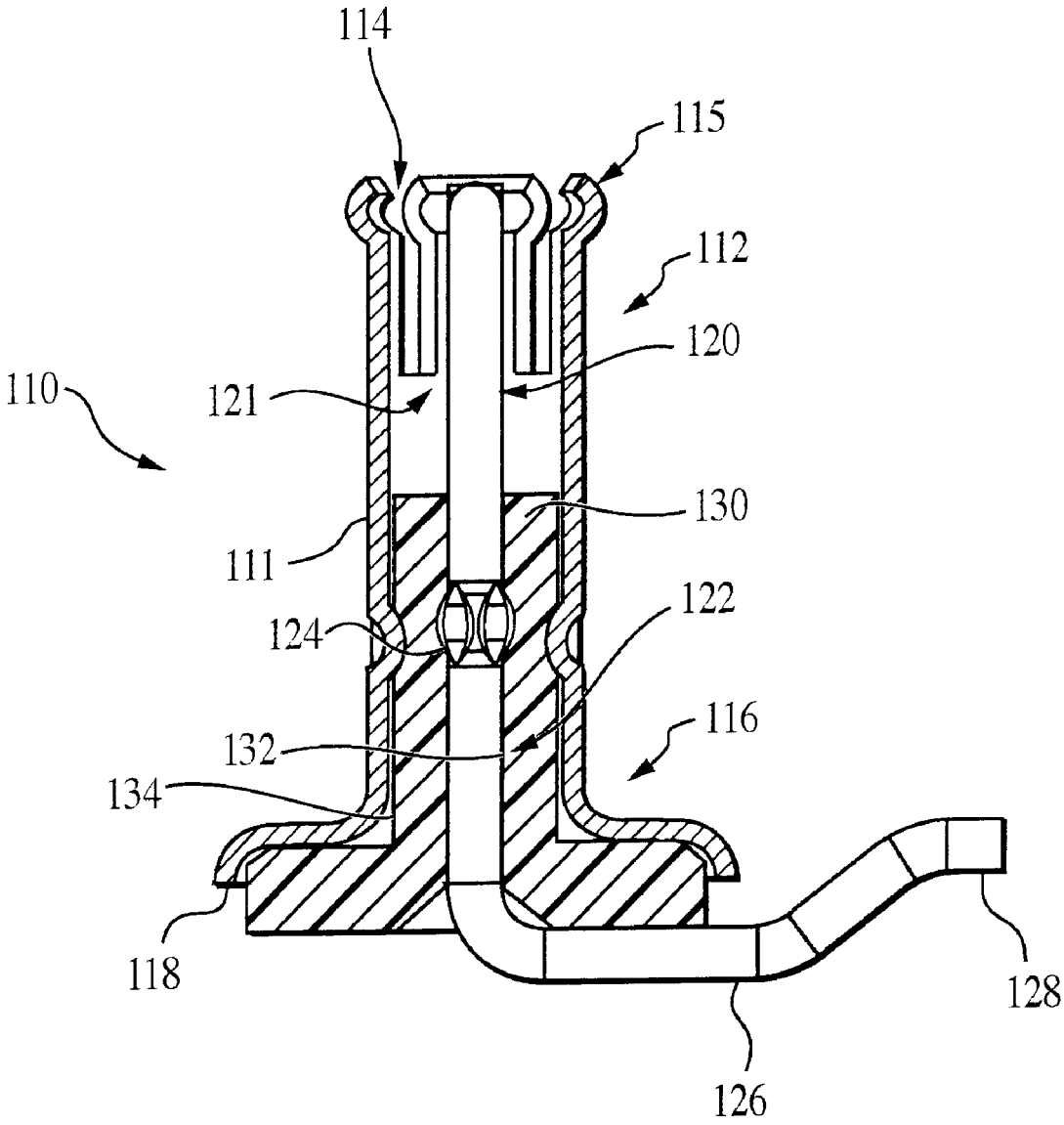
FIG. 5 illustrates a sectional elevation view of an alternate embodiment of a plug assembly formed in accordance with an embodiment of the present invention.

FIG. 5 illustrates a sectional elevation view of an alternate embodiment of a plug assembly 110 that features a different mounting style to a circuit board. The plug assembly 110 comprises a plug shell 111, a plug contact 120, and a plug dielectric 130. The plug dielectric 130 may be pressed into the plug shell 111, and the plug contact 120 may be pressed into the plug dielectric 130. In this way, the plug contact 120 may be fixed inside the plug shell 111.

The plug shell 111 comprises an upper portion 112 and a lower portion 116. The upper portion 112 comprises slots 114 and bulges 115. The bulges 115 are sized such that they will contact the interior of the inner jack shell 20 (with the slots 114 helping the upper portion 112 to bias resiliently inward) when the plug assembly 110 and the jack assembly 11 are mated. The lower portion 116 comprises a generally circular base 118 for mounting to the second circuit board 14. The interior of the lower portion 116 has one or more diameters configured to accept the plug dielectric 130. For the plug shell 120 to provide a conductive path between the inner jack shell 20 and the second circuit board 14, a conductive material is used for the plug shell 120. Phosphor bronze may be used for the plug shell 120.

The plug contact 120, which has a generally circular cross-section, comprises an upper portion 121 and a lower portion 122. The upper portion 121 is sized to be accepted by the slot 35 of the upper center contact 32 and features a tapered leading edge. The lower portion 122 comprises projections 124 that help secure the plug contact 120 in the plug dielectric 130. The lower portion 122 includes a tail 126 with several bends as it extends away from the upper portion 121 and terminates in a contacting portion 128. The plug contact 120 provides a conductive path between the second circuit board 14 and the upper center contact 32, and is made of a conductive material, such as brass.

The plug dielectric 130 resides between the plug shell 111 and the plug contact 120 and comprises an inner surface 132 and an outer surface 134. The inner surface 132 comprises a generally cylindrical opening configured to accept the plug contact 120, while the outer surface 134 defines a surface configured to be accepted by the interior part of the lower portion 116 of the plug shell 111. The plug contact 120 is pressed into the plug dielectric 130 and held in place by the resilience of the material, surface features on the lower portion 122 (such as the projections 124) and/or the inner surface 132, stakes, rivets, and/or other mounting techniques, either alone or in combination.

The plug dielectric 130 is pressed into the plug shell 120 and held in place by the resilience of the material, surface features on the outer surface 134 and/or the interior surface of the lower portion 116 of the plug shell 111, stakes, rivets, and/or other mounting techniques, either alone or in combination. A surface of the contacting portion 128 is substantially flush with the mounting surface of the base 118 when the plug assembly 111 is assembled to facilitate soldering the contacting portion 128 and the base 118 to the second circuit board 14. The plug dielectric 130 provides physical support to the plug contact 120 and helps insulate the plug contact 120 from the plug shell 111. Thus, the plug dielectric 130 allows two different paths of electrical conduction through the plug assembly 111. The material used for the plug dielectric 130 is selected to have a dielectric constant to provide a desired characteristic impedance for improved performance. PTFE may be used for the plug dielectric 130.

To mount the plug assembly 111 to the second circuit board 14, standard soldering techniques may be used. The plug assembly 111 is lowered to a cutout (not shown) on the second circuit board 14, and the base 118 is soldered to a base pad (not shown) on the second circuit board 14. The contacting portion 128 of the tail 126 is soldered to a contact pad (not shown) on the second circuit board 14. Thus, the mounted plug assembly 111 provides two paths of electrical conductivity. An outer path is formed from the plug shell 120 to the base pad of the second circuit board 14. An inner path is formed from the plug contact 120 to the contact pad of the second circuit board 14.

The mating of the jack assembly 11 and the plug assembly 12 to electrically connect the first circuit board 13 and the second circuit board 14 will now be described, with reference to FIGS. 1–4. With the jack assembly 11 mounted to the first circuit board 13 and the plug assembly 12 mounted to the second circuit board 14, the circuit boards are brought towards each other, with the surfaces to which the jack and plug assemblies are mounted facing each other, and the plug assembly 12 positioned to be accepted by the inner jack assembly 16.

The radial float in the jack assembly 11 allows it to be mated to the rigid plug assembly 12, even if they are initially misaligned. If the jack assembly 11 and plug assembly 12 are misaligned, at least one of the bulges 95 of the plug shell 90 will encounter the interior of the top portion 22 of the inner jack shell 20 as the jack assembly 11 and plug assembly 12 are urged toward each other. As the jack assembly 11 and plug assembly 12 are further urged together, the upper portion 92 of the plug shell 90 will travel deeper into the inner jack shell 20. Because the upper portion 92 of the plug shell 90 slides against the sloped interior surface of the top portion 22 of the inner jack shell 20, the inner jack assembly 16 will bias with respect to the outer jack assembly 17 as the upper portion 92 is funneled down the top portion 22, until the inner jack assembly 16 is aligned with the plug assembly 12. At this point, the bulges 95 will contact the inner jack shell 20 at the bend 23.

Further urging the plug assembly 12 and the jack assembly 11 towards one another will result in the upper portion 92 of the plug shell 90 biasing inwards as the bulges 95 contact the interior of the middle portion 24 of the inner jack shell 20. The resiliency of the upper portion 92 helps maintain pressure for electrical continuity of a signal path between the plug shell 90 and the inner jack shell 20. Because there is clearance in the axial direction within the middle portion 24 of the inner jack shell 20 where the bulges 95 reside both toward the top portion 22 and toward the bottom portion 26, the plug assembly 12 and jack assembly 11 may be mated even if there is axial misalignment as well as radial misalignment.

After the upper portion 92 of the plug shell 90 and the inner jack shell 20 become aligned and as they begin engaging each other, the plug contact 100 begins to engage the upper center contact 32, as the tapered leading edge of the upper portion 101 of the plug contact 100 enters the slot 35. As the plug contact 100 further penetrates the upper center contact 32, the beams 34 are biased outwards. The resiliency of the beams 34 helps maintain pressure between the exterior of the upper portion 101 of the plug contact 100 and the interior of the beams 34 for electrical continuity of a signal path between the plug contact 100 and the upper center contact 32. The contacts are dimensioned to provide an axial clearance between the leading edge of the plug contact 100 and the base of the slot 35, thereby allowing the plug contact 100 and the upper center contact 32 to be mated even if there is axial misalignment.

With the jack assembly 11 and the plug assembly 12 mated, there are two paths of electrical communication between the first circuit board 13 and the second circuit board 14. An outer path is formed from the foot pads of the first circuit board 13, to the outer jack shell 50 via the feet 56, to the inner jack shell 20 via the contact surface 31, to the plug shell 90 via the bulges 95, and to the foot pads of the second circuit board 14 via the feet 96 of the plug shell 90. An inner path is formed from the contact pad of the first circuit board 13, to the lower center contact 64 via the lower contacting surface 74, to the upper center contact via the contacting surface 37, to the plug contact 100 via the engagement of the plug contact 100 with the beams 34, and to the contact pad of the second circuit board 14 via the contacting surface 106. Thus, an inner path and an outer path are provided between the circuit boards.

While particular elements, embodiments and applications of the present invention have been shown and described, it will be understood, of course, that the invention is not limited thereto since modifications may be made by those skilled in the art, particularly in light of the foregoing teachings. For example, instead of being parallel to each other, the circuit boards or other electrical components being electrically connected could be perpendicular to each other, or at any angle. Also, the relative motion of the upper center contact 32 and the lower center contact 64 need not be limited to sliding, but could also include, for example, tilting additionally or alternatively to sliding. As a further example, the shells of the jack could be reversed wherein the inner shell is mounted to a circuit board with respect to which the outer shell floats radially. It is therefore contemplated by the appended claims to cover such modifications as incorporate those features which come within the spirit and scope of the invention.

What is claimed is:

1. A coaxial connector comprising:

a first shell comprising a cavity;

a second shell residing in said cavity and being movable relative to said first shell;

a first contact residing in said first shell; and a second contact residing in said second shell in direct contact with said first contact, wherein said first and second contacts have first and second contact surfaces, respectively, that engage one another in a contact plane and that slide relative to one another along said contact plane while remaining in direct contact with one another at said contact plane.

2. The coaxial connector of claim 1 wherein said first and second contacts are aligned along first and second longitudinal axes, respectively, that directly overlap and are common with one another when said first and second shells are in an unbiased position, said first and second contact surfaces radially floating with respect to one another such that said first and second longitudinal axes no longer overlap one another when said first and second shells are in a biased position with respect to one another.

3. The coaxial connector of claim 1 wherein said first contact includes upper and lower contact arms joined by an intermediate portion that biases said upper contact arm into direct engagement with said second contact.

4. The coaxial connector of claim 1 wherein said first and second shells define first and second longitudinal axes, respectively, that directly overlap and are common with one another when said first and second shells are in an unbiased position, said being moveable relative to one another while remaining in direct contact with one another when said first and second shells are in a biased position with respect to one another such that said first and second longitudinal axes are at an acute angle with respect to one another.

5. The coaxial connector of claim 1 further comprising a spring residing between said first and second shells and urging said first and second shells together, said spring being a tapered spring defining a first and second diameter, said spring contacting said first shell at said first diameter and contacting said second shell at said second diameter.

6. The coaxial connector of claim 1, further comprising a flared end configured to receive a mating coaxial connector.

7. The coaxial connector of claim 1, wherein said second contact is movable with respect to said first shell to align with a mating contact in a mating coaxial connector, said second contact remaining physically abutted to said first contact throughout movement to align with the mating contact.

8. The coaxial connector of claim 1, wherein said second contact is configured to engage a center coaxial contact of a mating connector, and one of said first and second shells is configured to engage an outer coaxial contact of a mating connector.

9. The coaxial connector of claim 1, wherein said second shell is movable with respect to said first shell to align with a mating contact in a mating coaxial connector, said second contact remaining physically abutted against said first contact throughout movement to align with the mating contact.

10. The coaxial connector of claim 1, wherein said first contact has a closed C-shape with a top leg of said first contact being biased with respect to a bottom leg of said first contact to provide a direct electrical path between said top and bottom legs.

11. An electrical connector system comprising:

a first circuit board;

a second circuit board;

a first connector mounted to said first circuit board, said first connector comprising an outer body comprising a mounting area for mounting to said first circuit board and a cavity, an inner body residing in said cavity and being in contact with and movable relative to said outer body, a first contact residing in and being radially fixed to said outer body and having a contacting surface for electrically communicating with said first circuit board, and a second contact residing in said inner body in direct contact with said first contact, said first and second contacts being movable relative to each other while maintaining direct contact therebetween; and a second connector mounted to said second circuit board and matable to said first connector, said second connector comprising a body and a contact residing in said body, said contact having a contacting surface for electrically communicating with said second circuit board, said contact engaging said second contact of said inner body when said first and second connectors are mated to provide electrical communication between said first and second circuit boards.

12. The electrical system of claim 11 wherein said first contact includes upper and lower contact arms joined by an intermediate portion that biases said upper contact arm into direct engagement with said second contact.

13. The electrical system of claim 11 further comprising a spring residing between said inner and outer bodies, said spring urging said inner and outer bodies together.

14. The electrical system of claim 13, wherein said spring is a tapered spring defining a first and second diameter, said spring contacting said outer body at said first diameter and contacting said inner body at said second diameter.

15. The electrical system of claim 11, wherein said second contact of said inner body and said contact of said second connector are configured to engage each other and provide a first path of electrical communication between said first and second circuit boards, and said inner body of said first connector and said body of said second connector are configured to engage each other and provide a second path of electrical communication between said first and second circuit boards.

16. The electrical connector system of claim 11 wherein said first and second contacts have first and second contact surfaces, respectively, and are aligned along first and second longitudinal axes, respectively, that directly overlap and are common with one another when said outer and inner bodies are in an unbiased position, said first and second contact surfaces radially floating with respect to one another such that said first and second longitudinal axes no longer overlap one another when said inner and outer bodies are in a biased position with respect to one another.

17. A coaxial connector comprising:

a first shell comprising a cavity;

a second shell residing in said cavity, contacting said first shell, and being movable relative to said first shell while remaining in contact;

a first contact mounted in said first shell, said first contact having a closed C-shape with a top leg of said first contact being biased with respect to a bottom leg of said first contact to provide a direct electrical path between said top and bottom legs; and a second contact mounted in said second shell in direct contact with said first contact, said first and second contacts remaining in direct contact with one another while said first and second shells are moved relative to each other.

18. The coaxial connector of claim 17 further comprising a first dielectric residing in said first shell and a second dielectric residing in said second shell, said first and second contacts mounted to said first and second dielectrics, respectively.

19. The coaxial connector of claim 17 wherein said first and second shells have substantially planar first and second contact surfaces, respectively, that slide parallel to one another while remaining in direct contact with one another.

20. The coaxial connector of claim 17 wherein said first and second shells define first and second longitudinal axes, respectively, that directly overlap and are common with one another when said first and second shells are in an unbiased position, said first and second contacts having first and second contact surfaces, respectively, that move relative to one another while remaining in direct contact with one another when said first and second shells are in a biased position with respect to one another such that said first and second longitudinal axes no longer overlap one another.

21. The coaxial connector of claim 17 wherein said first and second shells define first and second longitudinal axes, respectively, that directly overlap and are common with one another when said first and second shells are in an unbiased position, said first and second contacts having first and second contact surfaces, respectively, that move relative to one another while remaining in direct contact with one another when said first and second shells are in a biased position with respect to one another such that said first and second longitudinal axes are at an acute angle with respect to one another.

22. The coaxial connector of claim 17 further comprising a spring residing between said first and second shells and urging said first and second shells together, said spring being a tapered spring defining a first and second diameter, said spring contacting said first shell at said first diameter and contacting said second shell at said second diameter.

23. The coaxial connector of claim 17, wherein said second contact is configured to engage an inner contact of a mating connector and provide a first path of electrical communication between said coaxial connector and a mating connector, and said second shell is configured to engage an outer contact of a mating connector and provide a second path of electrical communication between said coaxial connector and a mating connector.

* * * * *